US011318458B2

(12) United States Patent
Lutnesky et al.

(10) Patent No.: US 11,318,458 B2
(45) Date of Patent: May 3, 2022

(54) CASSETTE SUBSTRATES MADE OF POLYETHERIMIDE

(71) Applicant: HEWLETT-PACKARD DEVELOPMENT COMPANY, L.P., Spring, TX (US)

(72) Inventors: Gary G. Lutnesky, Corvallis, OR (US); Paul Schweitzer, Corvallis, OR (US); Michael W. Cumbie, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 219 days.

(21) Appl. No.: 16/493,084

(22) PCT Filed: Apr. 3, 2017

(86) PCT No.: PCT/US2017/025767
§ 371 (c)(1),
(2) Date: Sep. 11, 2019

(87) PCT Pub. No.: WO2018/186829
PCT Pub. Date: Oct. 11, 2018

(65) Prior Publication Data

US 2020/0061602 A1 Feb. 27, 2020

(51) Int. Cl.
*B01L 3/02* (2006.01)

(52) U.S. Cl.
CPC ..... *B01L 3/0241* (2013.01); *B01L 2200/12* (2013.01); *B01L 2300/06* (2013.01); *B01L 2300/12* (2013.01); *B01L 2300/16* (2013.01)

(58) Field of Classification Search
CPC ..... B01L 3/0241; B01L 2200/12; B01L 2300/06; B01L 2300/12; B01L 2300/16;
(Continued)

(56) References Cited

U.S. PATENT DOCUMENTS 4,891,397 A * 1/1990 Liu ..... C08L 79/08 524/141
5,533,913 A * 7/1996 Boehm ..... H01R 4/36 439/810
(Continued)

FOREIGN PATENT DOCUMENTS

DE 19826896 A1 3/2000
JP 2002006428 A 1/2002
(Continued)

OTHER PUBLICATIONS

Jubery, T.Z.; "A New Fabrication Technique to Form Complex Polymethylmethacrylate Microchannel for Bioseparation"; Mar. 2012.

*Primary Examiner* — Jennifer Wecker
*Assistant Examiner* — Oyeleye Alexander Alabi
(74) *Attorney, Agent, or Firm* — Fabian VanCott

(57) ABSTRACT

A cassette may include a substrate and a die coupled to the substrate wherein the substrate is made of modified polyetherimide (PEI). A system for ejecting a fluid into an assay may include at least one dispense head, the at least one dispense head including a substrate and a die coupled to the substrate wherein the substrate is made of modified polyetherimide (PEI).

20 Claims, 6 Drawing Sheets

(58) Field of Classification Search
CPC ..... B01L 2300/0645; B01L 2400/0415; B01L 3/502715; B01L 3/0268
See application file for complete search history.

(56) References Cited

U.S. PATENT DOCUMENTS

| | | | | |
|---|---|---|---|---|
| 5,589,860 | A | 12/1996 | Sugata et al. | |
| 5,612,725 | A | 3/1997 | Okimoto | |
| 5,895,313 | A | 4/1999 | Ikezaki et al. | |
| 6,502,926 | B2 | 1/2003 | Cook et al. | |
| 6,809,412 | B1 * | 10/2004 | Tourino | B81B 7/007 257/678 |
| 7,244,392 | B1 | 7/2007 | Konecke | |
| 7,264,917 | B2 | 9/2007 | Hu et al. | |
| 8,475,704 | B2 | 7/2013 | Zhao et al. | |
| 2002/0180016 | A1 * | 12/2002 | Shrauger | H01L 23/15 257/678 |
| 2004/0124957 | A1 * | 7/2004 | Eliacin | B81C 1/00333 333/262 |
| 2012/0242749 | A1 | 9/2012 | Moorlag et al. | |
| 2015/0148549 | A1 | 5/2015 | Van Dam et al. | |
| 2016/0047770 | A1 * | 2/2016 | Tyler | G01N 33/4836 506/39 |

FOREIGN PATENT DOCUMENTS

| | | | |
|---|---|---|---|
| RU | 148306 | U1 | 11/2014 |
| RU | 151643 | U1 | 4/2015 |
| WO | WO-2010141642 | A1 | 12/2010 |
| WO | WO-2013114295 | | 8/2013 |

* cited by examiner

CASSETTE SUBSTRATES MADE OF POLYETHERIMIDE

BACKGROUND

An "assay run" is an investigative or analytic event used in, for example, laboratory medicine, pharmacology, analytical chemistry, environmental biology, or molecular biology, for qualitatively assessing or quantitatively measuring the presence, amount, or the functional activity of a sample. The sample may be a drug, a genomic sample, a proteomic sample, a biochemical substance, a cell in an organism, an organic sample, or other inorganic and organic chemical samples. An assay run may measure an intensive property of the sample and express it in the relevant measurement unit such as, for example, molarity, density, functional activity in enzyme international units, degree of some effect in comparison to a standard, among other measurable characteristics. An assay may involve reacting a sample with a number of reagents, and may be classified as an instance of an assay procedure conforming to an assay protocol. An assay protocol may involve a set of reagent and/or sample fluids being dispensed in specific amounts to a number of assay reaction sites such as wells within an assay plate. Further, an assay protocol may include additional processing such as mixing, separation, heating or cooling, incubation, and eventually at least one read-out. The reproducibility and run-to-run comparability of an assay depends on the reproduction of its protocol.

BRIEF DESCRIPTION OF THE DRAWINGS

The accompanying drawings illustrate various examples of the principles described herein and are a part of the specification. The illustrated examples are given merely for illustration, and do not limit the scope of the claims.

Figure 1:
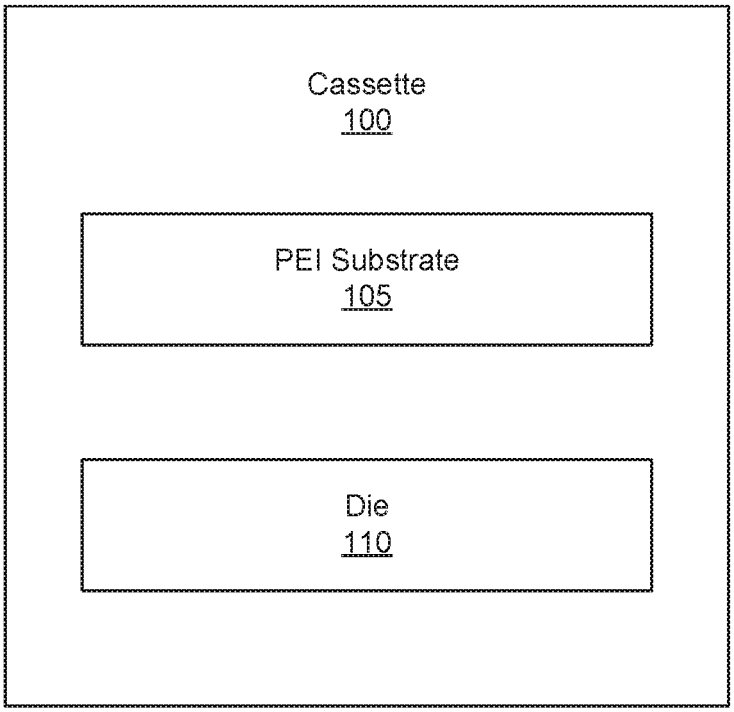
FIG. 1 is a block diagram of a cassette according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Assay runs, as described above, have been done by hand using, for example a pipette. In order to complete the assay, a user may selectively take a sample using the pipette and eject a metered amount of the sample into individual wells of an assay plate. This is all done by hand and has proven to be relatively time consuming. Additionally, because a human is ejecting the samples into the individual wells of the assay plate, mistakes may be made and an extra amount of the sample may be added to any particular well or a portion of sample may not be added at all.

To place user interaction to a minimum, automated assay fluid dispensing systems have been developed that may dispense assay fluids, e.g., samples and reagents, in a precise, controlled fashion to multiple reaction sites within an assay plate in a short time. Some automated fluid ejection systems employ a fluid-ejection driver that uses interchangeable cassettes. The cassettes may contain the assay fluids and may be controlled so that they deposit assay fluids onto reaction sites. For example, a reaction medium may be moved relative to the cassette so that, over a relatively short time, an assay fluid may be deposited in the same or varying amounts at different reaction sites of the reaction medium.

These cassettes can be used so that single or multiple fluids can be dispensed contemporaneously. For example, multiple samples can be deposited at respective reaction sites in parallel or quickly in serial in order to reduce the time to titrate a plurality of samples. Herein, "cassette" refers to a user-replaceable component of a dispensing system, through which at least one fluid flow in, respectively, at least one fluid channel is provided before being dispensed from the dispensing system.

These cassettes may be subjected to relatively high temperatures during certain processes. One of these processes is an epoxy curing process with an adhesive epoxy used to couple a silicon die to a surface of the cassette. Another process may include a thermosonic wirebonding process used to wirebond a number of silicon die pads to a number of electrical traces formed on the surface of the cassette. Still another process may include covering those wirebonds with an adhesive epoxy. Again, these processes may include subjecting the cassette to relatively high temperatures up to and including about 160° Celsius or even higher.

Additionally, the cassettes may be produced with specific dimensional tolerances. As described above, the cassettes interface mechanically with automated assay fluid dispensing systems. The interface may include a number of electrical contact pads electrically coupling the automated assay fluid dispensing systems to the silicon die coupled to the cassette. Alterations in the position of the silicon die with respect to the cassette as well as the position of the electrical contact pads may result in a defective cassette or poor fluid ejection performance of the silicon die.

Examples described herein provide for such a cassette that is thermally stable when subjected to temperatures as high as 160° Celsius or even higher. Additionally, examples described herein provide for such a cassette that may be manufactured with minimized dimensional tolerances. In some examples, the tolerances may be as small as 0.003 inches.

The present specification describes a cassette including a substrate and a die coupled to the substrate wherein the substrate is made of modified polyetherimide (PEI).

The present specification further describes a system for ejecting a fluid into an assay including at least one dispense head, the at least one dispense head including a substrate and a die coupled to the substrate wherein the substrate is made of modified polyetherimide (PEI).

The present specification also describes a micro electromechanical system (MEMs) device, including a substrate and a die coupled to the substrate wherein the substrate is made of modified polyetherimide (PEI) mixed with hydrous magnesium silicate.

As used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

FIG. 1 is a block diagram of a cassette (100) according to an example of the principles described herein. The cassette (100) may include a substrate (105) made of modified polyetherimide (PEI) and a die (110) coupled to the substrate.

The die (110) may be any device that may eject an amount of fluid from the cassette (100). In an example, the die (110) is a silicon die. In an example, the die (110) may include any number of layers of any type of material. In an example, the die (110) may include a silicon substrate having a rear face of the silicon die being exposed to atmosphere via a slot to receive fluid from a reservoir. A fluid to be ejected from the die (110) may be placed in the reservoir and, via the slot, may be provided to the die (110) for ejection of the fluid. The die (110) may further include a nozzle plate layer that includes a number of nozzles through which the fluid is ejected.

The substrate (105) may be in any form and may have the die (110) coupled thereto. As described above, the substrate (105) may be formed to interface with an automated fluid ejection system. The automated fluid ejection system may send a number of electrical signals to the die (100) coupled to the substrate (105) in order to direct the die (110) to eject an amount of fluid at or within a predetermined location. In order to accomplish this, the coupling interface of the die (110) with the substrate (105) may be at a predetermined location on the substrate (105) such that the automated fluid ejection system may be able to carry the cassette (100) to a specific location and eject an amount of fluid in a correct and predetermined location. Additionally, the substrate (105) may include a number of electrical traces defined on the surface thereof so that the automated fluid ejection system may interface with the die (110). The interface may include electrical contacts that interface with a number of electrical pads defined on the electrical traces. Because the physical location of these electrical contacts of the automated fluid ejection system will not change their location, the location for the electrical pads defined on the electrical traces of the substrate (105) will be manufactured to be in an appropriate location to interface with the cassette (100).

Additionally, the substrate (105) may be subjected to temperatures of around 160° Celsius or higher during the manufacturing process. In an example, during the various manufacturing processes of the substrate (105) and cassette (100), the substrate (105) may be subjected to temperatures ranging from 100° to 200° Celsius. These processes may include the curing of an epoxy between the die (110) and the substrate (105), the curing of an epoxy laid over the above mentioned electrical traces, injection molding of the body of the substrate (105), among other manufacturing processes. During this curing process, the adhesive epoxy may adhere to the PEI of the substrate (105). This is because of the polarity of the PEI allows the adhesive epoxy to readily couple to the surface of the substrate (105).

To prevent the distortion and/or destruction of the substrate (105) during the manufacture of the substrate (105), the substrate (105) is made of polyetherimide (PEI). In an example, the substrate (105) is made entirely of PEI. In an example, the substrate (105) is made of a mixture of PEI and hydrous magnesium silicate. In this example, the PEI modified by the hydrous magnesium silicate prevents the substrate (105) from distorting during, for example, an injection molding process. Further, the addition of the hydrous magnesium silicate to modify the PEI prevents shrinkage of the substrate (105) after the injection molding process thereby minimizing dimensional tolerances and maintaining the molded shape of the substrate (105) for later coupling of the die (110) thereto.

The use of PEI in the manufacturing of the substrate (105) of the cassette (100) produces a thermally stable part when exposed to the curing temperatures of the epoxy described herein. Additionally, the PEI has a compatibility with solvents that may contact the surface of the substrate (105) during operation of the cassette (100). Specifically, during operation of the cassette (100) an amount of fluid to be added to an analyte, titration, or other chemical reaction or analysis is passed over the surface of the substrate (105), funneled towards the die (110), and eventually ejected by the die (110). In such chemical reactions or analysis processes, it would not be advantageous for substances from the substrate (105) be allowed to leach into the fluid, absorb into the substrate (105), or otherwise effect the fluids chemical nature. PEI prevents this leaching or absorption of the fluid being dispensed.

Further, the PEI has a high surface energy that enhances drainage of the fluid from the reservoir and to the die (110). During operation of the cassette (100), a certain amount of fluid is added to the reservoir leading to the die (110). All of this certain amount may be used to complete the chemical titration or analysis or the fluid used may be costly or rare to use during the analysis. The high surface energy prevents stranding of the fluid within the reservoir thereby lowering operation costs and/or correct analysis.

As described herein, in an example the substrate (105) may be modified by mixing into the PEI an amount of filler. In an example, the filler is hydrous magnesium silicate. By adding an amount of hydrous magnesium silicate, the substrate (105) may take on additional properties. In an example, the addition of hydrous magnesium silicate provides for control of part shrinking during the manufacturing of the cassette (100). In an example, the PEI modified by hydrous magnesium silicate is injection molded into a mold, allowed to cool, and removed from the mold. In this example, the shrinkage of the substrate (105) during the cooling process may be limited due, at least in part, to the inclusion of the hydrous magnesium silicate with the PEI.

Additionally, the PEI and the modified version of the PEI with the inclusion of the hydrous magnesium silicate increases the strength of the substrate (105). In an example a cross-sectional thickness of the substrate (105) is around between 700 and 800 mm. In an example, the substrate (105) may include a number of vias that pass from one side of the substrate (105) to the other side of the substrate. These vias may provide for an electrical connection between a number of electrical traces defined on both sides of the substrate (105). During manufacturing of the vias, an included angle of about 60° is formed on either side of the via using a laser direct structuring (LDS) process. As the thickness of the substrate (105) increases, the footprint of the vias also increases. Limiting the cross-sectional thickness of the substrate (105) reduces the footprint of these vias thereby increasing the available space to form additional electrical traces on the surfaces of the substrate (105). The PEI and its modified version using hydrous magnesium silicate increases the part strength allowing for relatively thinner substrates (105) and smaller vias.

In an example, the substrate (105) may be made of a modified PEI that includes hydrous magnesium silicate, glass fibers, glass particles, or combinations thereof. In either of these examples, the part strength and modulus of the substrate (105) may be increased allowing for thinner cross-sections.

During manufacturing of the substrate (105), the LDS process may be used to define a number of electrical traces on the surface of the substrate (105). The defined structures resulting from the LDS process may be filled with a metal that is electrically conductive such as copper or gold. The substrate (105) made of PEI allows for adhesion with the electrically conductive metal such that during the wire bonding process described herein, the electrically conductive metal is not ripped away from the surface of the substrate (105). In this example, the PEI may be modified with the hydrous magnesium silicate to create a relatively more robust substrate (105) that has a relatively higher wirebond strength.

Figure 2:
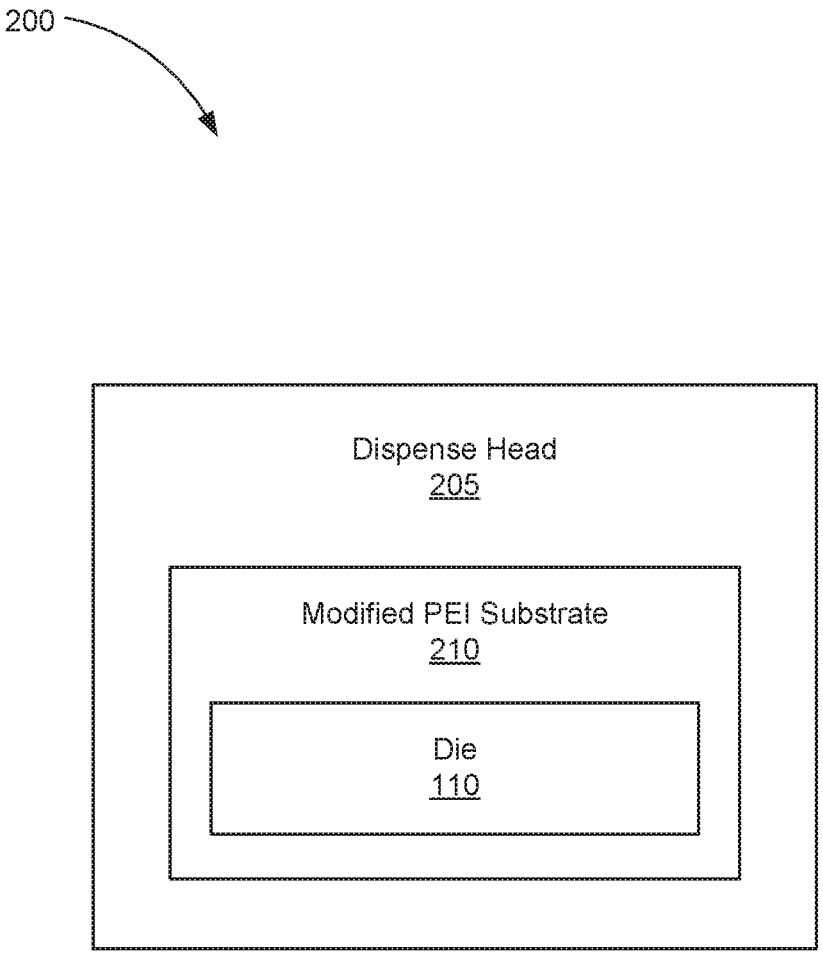
FIG. 2 is a block diagram of a system for ejecting a fluid into an assay according to an example of the principles described herein.

FIG. 2 is a block diagram of a system (200) for ejecting a fluid into an assay according to an example of the principles described herein. The system (200) may include a modified PEI substrate (105) as described herein. In an example, the modified PEI substrate (210) may include a filler. In an example the filler may be hydrous magnesium silicate, glass fiber, glass particles, or combinations thereof. A die (110) may be bonded to a surface of the modified PEI substrate (210).

Figure 3:
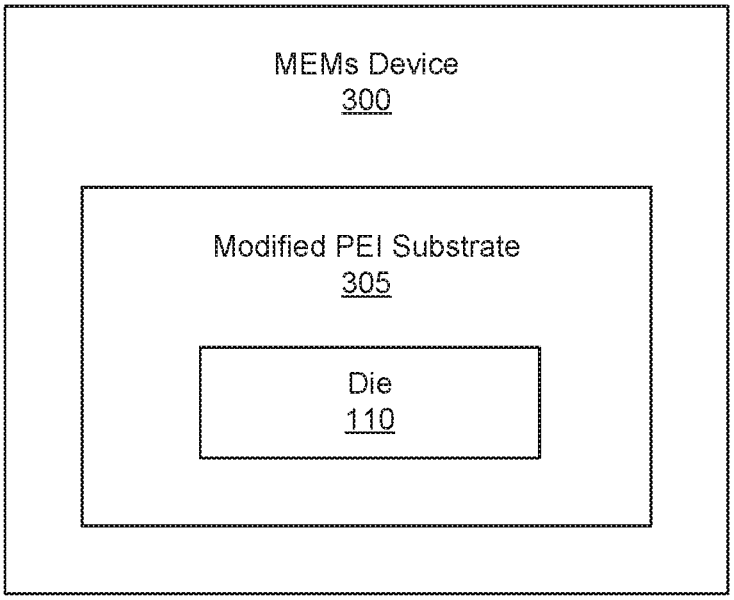
FIG. 3 is a block diagram of a micro electromechanical system (MEMs) device according to an example of the principles described herein.

In an example, the system (200) interfaces with an automated assay fluid dispensing system. The automated assay fluid dispensing system may interface with the system (200) via a number of electrical traces defined on the modified PEI substrate (210). Specifically, the automated assay fluid dispensing system may interface electronically with the die (110) through the electrical traces. During operation of the automated assay fluid dispensing system, the system (200) may be interfaced with the automated assay fluid dispensing system and an amount of fluid may be provided in a reservoir fluidically coupled with the die (110). Instructions may be sent to the die (110), at least, directing the die (110) to eject an amount of fluid therefrom, FIG. 3 is a block diagram of a micro electromechanical system (MEMs) device (300) according to an example of the principles described herein. The die (110) of the MEMs device (300) may include a number of fluid actuators driven by a variety of actuator mechanisms such as thermal bubble resistor actuators, piezo membrane actuators, electrostatic (MEMS) membrane actuators, mechanical/impact driven membrane actuators, voice coil actuators, magneto-strictive drive actuators, among others. The fluid actuators can be integrated into the MEMs device using microfabrication processes. This enables complex microfluidic devices having arbitrary pressure and flow distributions. The MEMs device may also include various integrated active elements such as resistive heaters, Peltier coolers, physical, chemical and biological sensors, light sources, or combinations thereof. With these devices in the die (110), the MEMs device (300) may cause an amount of fluid to be ejected as described herein. The modified PEI substrate (305) may include PEI and a filler such as hydrous magnesium silicate as described herein.

Figure 4A:
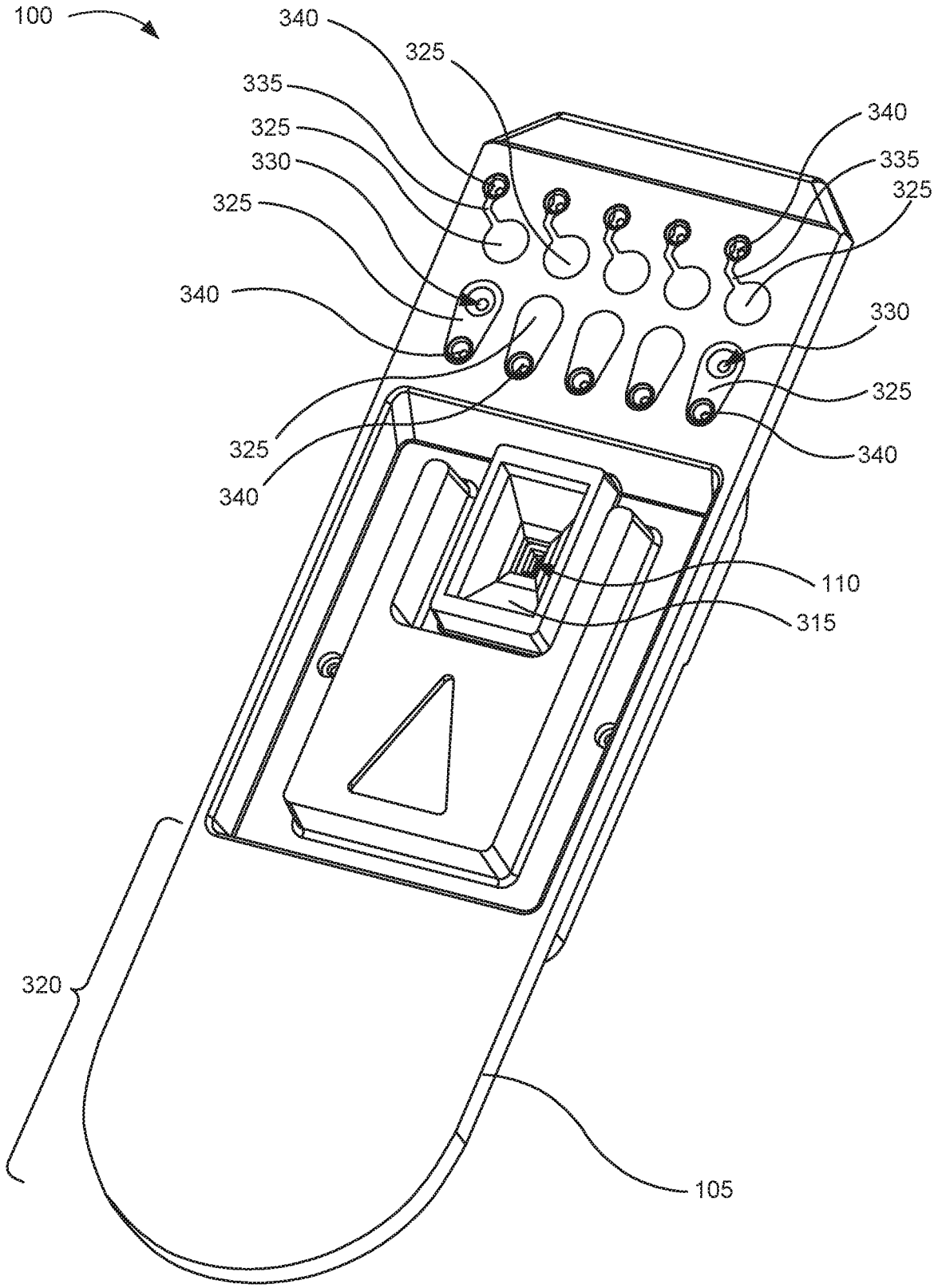
FIGS. 4A and 4B are front and rear perspective views, respectively, of a cassette according to a number of examples described herein.
Figure 4B:
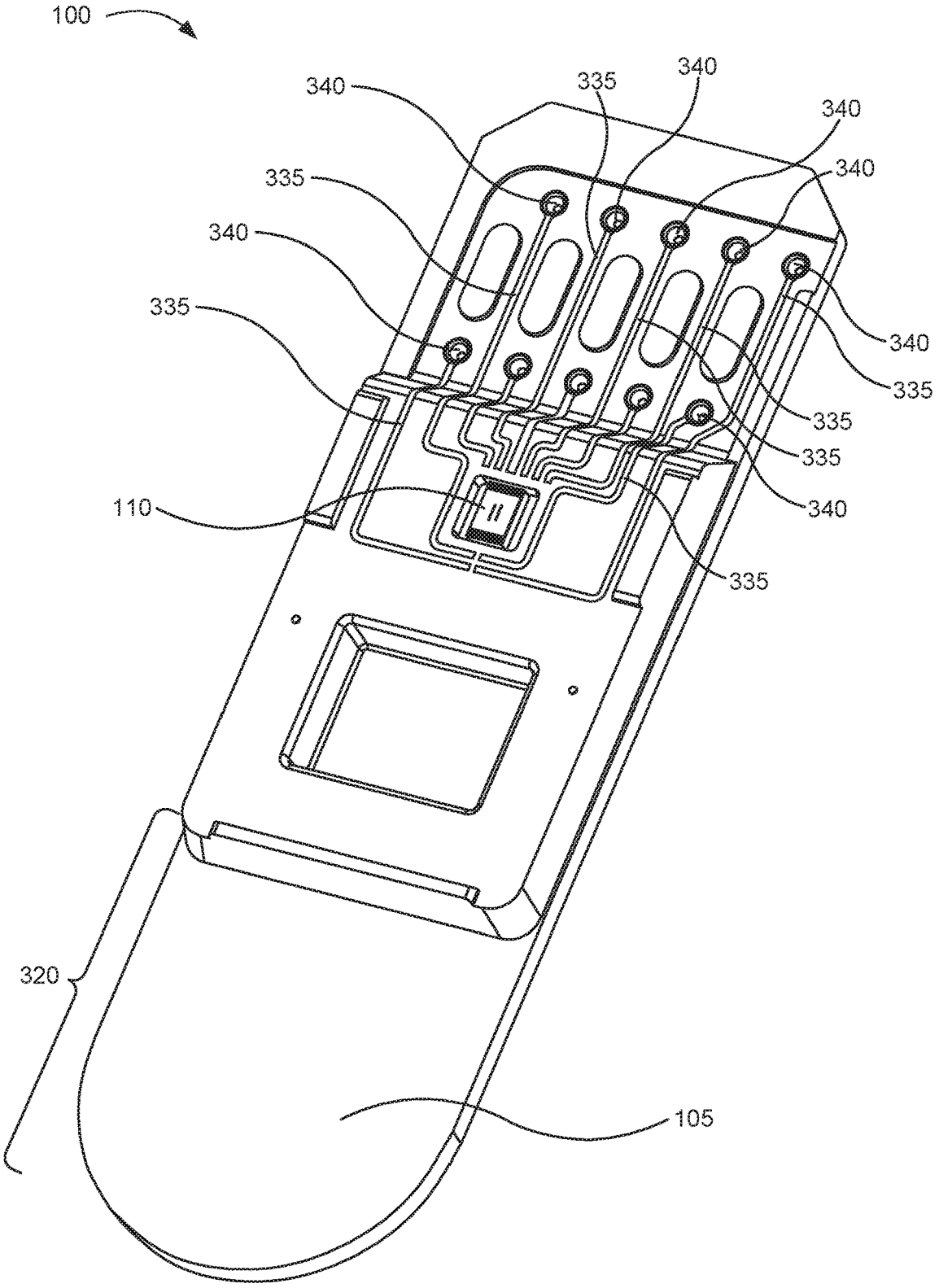

FIGS. 4A and 4B are front and rear perspective views, respectively, of a cassette (100) according to a number of examples described herein. As described above, the cassette (100) includes a substrate (105), a die (110) coupled to the substrate (105), and a reservoir (315) defined in the substrate (105). The cassette (100) with its substrate (105), die (110), and reservoir (315) may be similar to that cassette (FIG. 1, 100) as described in connection with FIG. 1.

The substrate (105) may be formed to allow a user to insert or otherwise interface the cassette (100) with a system for ejecting a fluid into an assay such as the automated fluid ejection system described herein. In the example show in FIG. 3, the substrate (105) may include a handle (320). The handle (320) allows a user to grip the cassette (100) in order to manipulate the cassette (100) and place the cassette (100) into the system used to eject a fluid into an assay.

The cassette (100) may further include a number of connection pads (325) and electrical traces (330) so that the die (110) of the cassette (100) can receive electrical signals directing when, where, and how to eject an amount of fluid therefrom. In an example, the cassette (100) is moved relative to an assay plate positioned below the cassette (100) such that placement of the die (110) over any portion of the assay plate and ejection of fluid from the die (110) allows an amount of fluid to be ejected into any number of wells formed in the assay plate. The ejection of the fluid from the die (110) is directed by a controller of the automated fluid ejection system as described herein.

Thus, in order to allow the cassette (100) to interface with the system for ejecting a fluid into an assay, the cassette (100) may include a number of contact pads (325) that interface with, for example, a number of pogo connectors on a printed circuit assembly (RCA) of the automated fluid ejection system. In the examples shown in the figures of the present description, the number of contact pads (325) is ten. However, the present specification contemplates the use of less or more contact pads (325). The number of contact pads (325) may be varied among different examples because the die (110) may receive signals from the RCA directing a number of microelectromechanical systems (MEMS) devices to be activated. Consequently, more or fewer contact pads (325) may be added or subtracted from those shown in FIG. 3 based on the number of signals used to activate any number of MEMS devices within the die (110). Not all of the contact pads (325) have been indicated in FIG. 3 in order to allow for better understanding of the cassette (100).

In an example, a number of traces (335) may electrically couple each of the contact pads (325) to a via (340). In other examples the contact pads (325) themselves may be electrically coupled to the their respective vias (340) without the use of traces (335).

In an example, the contact pads (325) and traces (335) may be formed onto the surface of the substrate (105) using a LDS process. Again, during the LDS process, the non-conductive, metallic, inorganic compounds are activated by a laser providing a surface into which a layer of conduct metal may be deposited using, for example, an electroless copper bath. The vias (340) may provide an electrical connection to a number of other traces (335) formed on an opposite side of the cassette (100).

FIG. 4B is a back, perspective view of the cassette (100) of FIG. 3 according to an example of the principles described herein. The vias (340) provide an electrical connection between the contact pads (325) on the front side of the cassette (100) to a number of traces (335) defined on the back side of the cassette (100). These traces (335) electrically couple each of the vias (340) to at least one die pad defined on the die (110). In this manner, a PCA may interface with the contact pads (325) defined on the front of the cassette (100) in order to send electrical signals to the die (110) to cause the die (110) to, at least, eject an amount of fluid therefrom.

Figure 5:
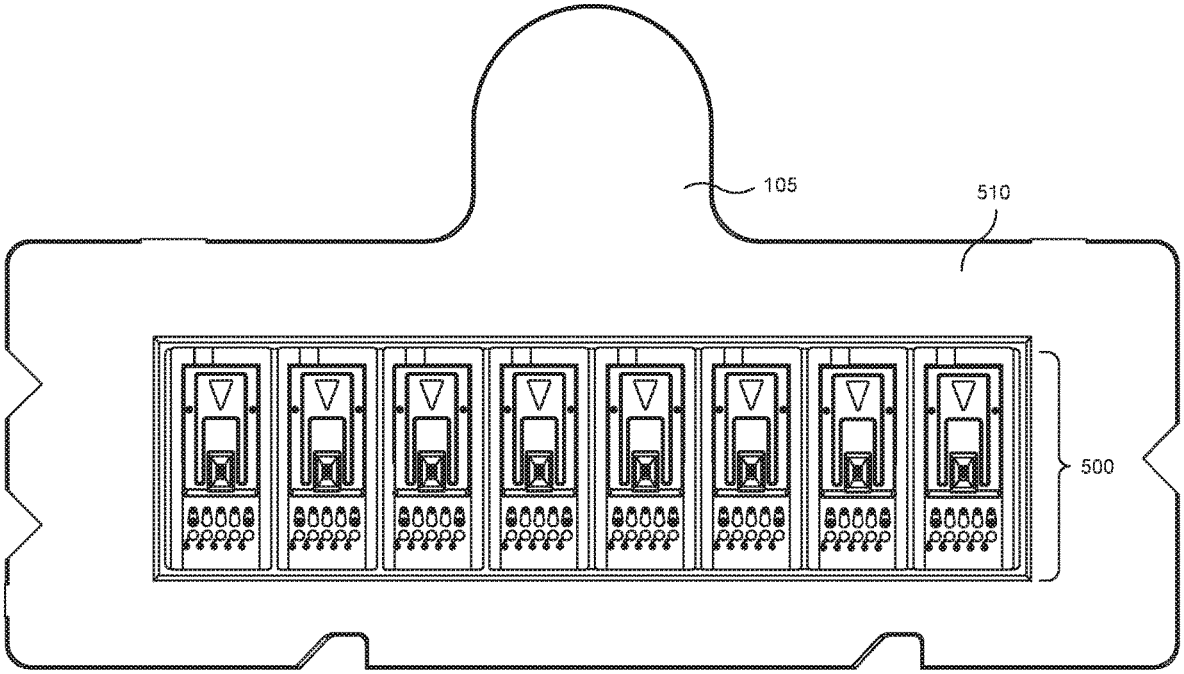
FIG. 5 is a front plan view of a number of dispense head assemblies formed in a substrate according to an example of the principles described herein.

As described herein, the cassette (100) of FIGS. 4A and 4B includes a reservoir (315). The reservoir (315), in this example, may generally be in the form of a funnel shape such that a user, during operation, may provide an amount of fluid therein. The funnel shape of the reservoir (315) may funnel the fluid to a slot defined above a proximal side of the die (110). Thus, the funnel shaped reservoir (315) as shown in FIGS. 4A and 4B, may provide a constant supply of fluid to the die (110) using gravitational forces, FIG. 5 is a front plan view of a number of dispense head assemblies (500) formed in a substrate (105) according to an example of the principles described herein. Each of the dispense head assemblies (500) may be placed within the substrate (105) and may include a die (110), reservoir (315), contact pads (325), contact seats (330), vias (340), traces (335), as described herein in connection with FIGS. 4A and 4B. In the example shown in FIG. 5, the dispense head assemblies (500) are mounted onto a frame (510). In an example, the dispense head assemblies (500) may be mechanically coupled to the frame (510) by, for example, a number of clips. In an example, the frame (510) forms the substrate (105) of each of the dispense head assemblies (500) such that each of the dispense head assemblies (500) are formed into a single monolithic frame (510).

The specification and figures describe a cassette substrate made of polyetherimide (PEI). The substrate provides for a cassette that is thermally stable to temperatures as high as 160° Celsius or higher. With the inclusion of a filler such as hydrous magnesium silicate with the PEI shrinkage of the part may be reduced providing for a substrate that has minimized dimensional tolerances. Further, the PEI modified by the hydrous magnesium silicate may increase part strength, create a relatively strong adhesive bond line strength, produce a high surface energy, be compatible with solvents used in the cassette, and have a high wirebond strength as described herein. As a result, the cost of manufacturing the substrate may be reduced as well with less materials being used to produce the substrate.

The preceding description has been presented to illustrate and describe examples of the principles described. This description is not intended to be exhaustive or to limit these principles to any precise form disclosed. Many modifications and variations are possible in light of the above teaching.

What is claimed is:

1. A cassette comprising:

a substrate; and a fluid dispensing die coupled to the substrate, the die comprising a slot to receive fluid into the die from a reservoir and a number of fluid actuators to selectively dispense the fluid out of the die;

wherein the substrate is made of modified polyetherimide (PEI).

2. The cassette of claim 1, wherein the modified PEI comprises a modifying agent.

3. The cassette of claim 2, wherein the modifying agent is hydrous magnesium silicate, glass fibers, glass particles, or combinations thereof.

4. The cassette of claim 1, further comprising a number of electrical traces on the surface of the substrate.

5. A system for ejecting a fluid into an assay comprising:

at least one dispense head, the at least one dispense head comprising:

a substrate; and a fluid dispensing die coupled to the substrate, the die comprising a slot to receive fluid into the die from a reservoir and a number of fluid actuators to selectively dispense the fluid out of the die;

wherein the substrate is made of modified polyetherimide (PEI).

6. The system of claim 5, wherein the modified PEI comprises a modifying agent.

7. The system of claim 6, wherein the modifying agent is hydrous magnesium silicate, glass fibers, glass particles, or combinations thereof.

8. The system of claim 5, further comprising a number of electrical traces on the surface of the substrate.

9. A micro electromechanical system (MEMs) device, comprising:

a substrate;

a fluid dispensing die coupled to the substrate, the die comprising a slot to receive fluid into the die from a reservoir and a number of fluid actuators to selectively dispense the fluid out of the die;

wherein the substrate is made of modified polyetherimide (PEI) mixed with hydrous magnesium silicate.

10. The MEMs device of claim 9, wherein the modified polyetherimide (PEI) further comprises one of glass fibers, glass particles, or combinations thereof.

11. The MEMs device of claim 9, further comprising a number of electrical traces on the surface of the substrate.

12. The system of claim 6, wherein the modifying agent comprises hydrous magnesium silicate.

13. The system of claim 5, wherein the at least one dispense head comprises:

a slot in the die to receive the fluid into the die from a reservoir; and a number of fluid actuators to selectively dispense the fluid out of the die.

14. The system of claim 6, wherein the modifying agent is glass fiber.

15. The system of claim 6, wherein the modifying agent is glass particles.

16. The system of claim 5, further comprising a number of vias in the substrate containing electrical connections to the die.

17. The system of claim 8, wherein the number of electrical traces are formed using laser direct structuring.

18. The system of claim 8, wherein the die comprises a number of pads and wherein the pads are electrically coupled to at least one of the electrical traces.

19. The system of claim 8, wherein a portion of the electrical traces are covered with a cured epoxy.

20. The system of claim 5, wherein the die is coupled to the substrate using an adhesive epoxy that adheres to the modified PEI.

* * * * *